United States Patent [19]

Lashley

[11] 4,157,050

[45] Jun. 5, 1979

[54] PEDAL GUITAR

[75] Inventor: Ronald T. Lashley, Burlington, N.C.

[73] Assignee: Emmons Guitar Company, Inc., Burlington, N.C.

[21] Appl. No.: 803,588

[22] Filed: Jun. 6, 1977

[51] Int. Cl.[2] ..... G10D 3/14

[52] U.S. Cl. ..... 84/312 P

[58] Field of Search ..... 84/200, 207, 306, 312

[56] References Cited

U.S. PATENT DOCUMENTS

| | | | |
|---|---|---|---|
| 2,122,396 | 7/1938 | Freeman | 84/312 P |
| 3,136,198 | 6/1964 | Smith et al. | 84/312 P |
| 3,447,413 | 6/1969 | Lashley et al. | 84/312 P |
| 3,748,943 | 7/1973 | Lashley | 84/312 P |

*Primary Examiner*—L. T. Hix

*Assistant Examiner*—Benjamin R. Fuller

[57] ABSTRACT

This invention consists of a novel string assembly for split tuning a steel guitar or other musical instrument having pedals or levers for varying the pitch of the sounds produced by the strings as they are plucked. The mechanism of this invention allows the musician to play a particular string and produce a musical tone absent any pedal movement, the same string played with a first pedal depressed produces a second tone and with only a second pedal depressed produces a third tone. A fourth tone is then capable of being produced by the string after split tuning when both pedals are simultaneously depressed.

12 Claims, 9 Drawing Figures

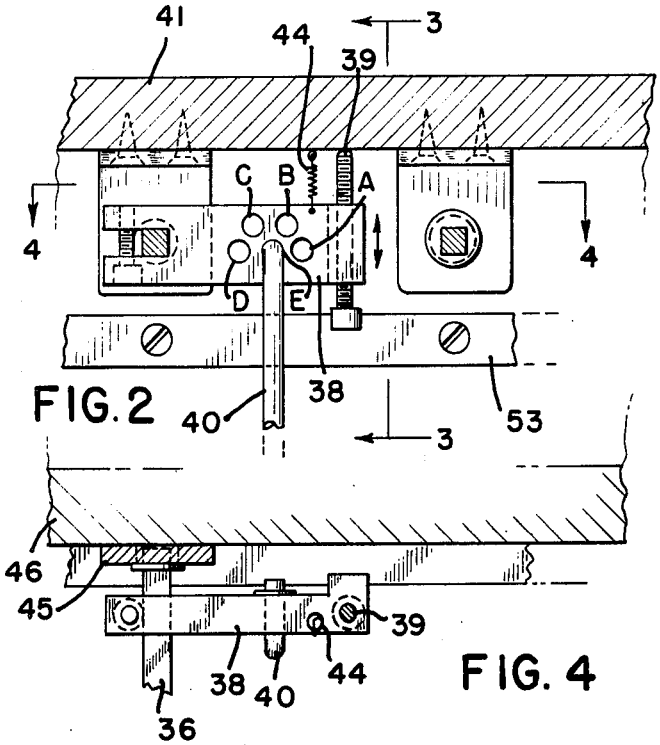
FIG. 2
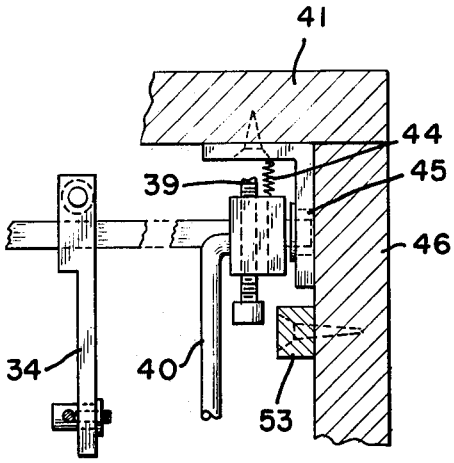
FIG. 3
FIG. 4
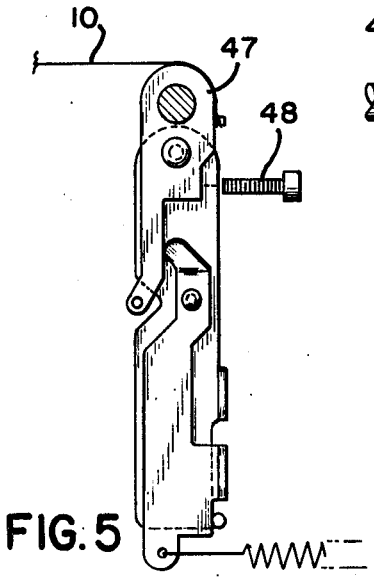
FIG. 5
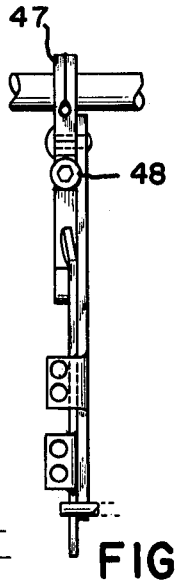
FIG. 6
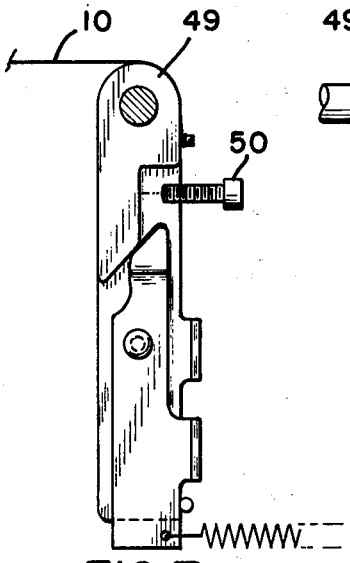
FIG. 7
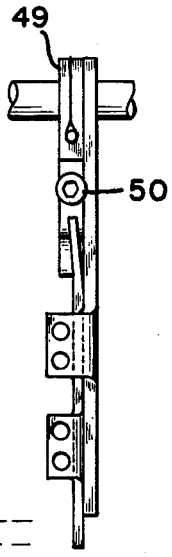
FIG. 8
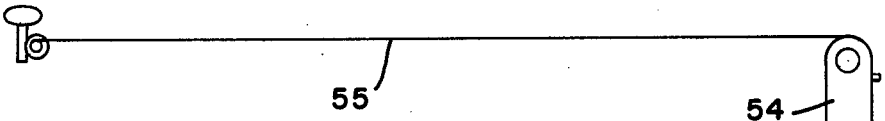
FIG. 9
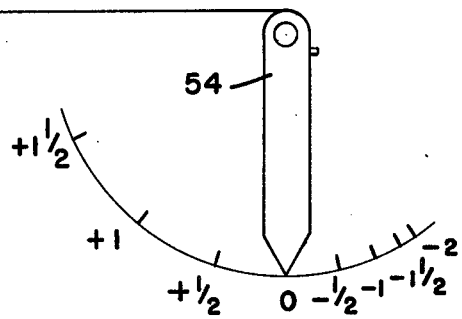

PEDAL GUITAR

BACKGROUND OF THE INVENTION

Steel guitars and other string musical instruments have long been manufactured having foot pedals or knee levers which are used by the musician during playing to produce different tones from the strings. It is understood herein that tones means desirable "on-key" notes and not distorted or "off-key" sounds.

It is common practice to tune the strings of a steel guitar in a particular chord in what is commonly referred to as the "open" condition, meaning that the tuning is done without the foot pedals being depressed. After the guitar is tuned in the open condition, it is retuned with the particular foot pedals with which the strings are associated in the depressed position. In this manner each string is tuned so that certain notes will be produced when the string is played without any pedals being depressed and it will also be tuned when each pedal is depressed producing different notes from that obtained in the open condition or position. As referred to herein pedals can mean hand, knee, foot or possibly other pedals or levers used for tone variations.

Oftentimes more than one pedal is connected to a particular string and it is common practice to connect various strings to one pedal or lever. For example a conventional twin-neck guitar may have a total of twenty strings, ten (10) on each neck, and eight foot pedals. Additionally, the guitar may have left and right knee levers each of which can be nudged in either the left or right direction to obtain pitch variation. Hence, eight foot pedals and two knee levers with dual positioning allows for twelve positions for achieving tone variations.

With the variety of pedals and levers used on conventional instruments, the problem of "split-tuning" has long plagued the industry. Split-tuning consists of tuning a string having two pedals connected to it so that a proper tone is produced when both pedals are simultaneously depressed. The tone thus produced may or may not be the same tone as that produced in the "open-condition."

An example of the problem utilizing a conventional instrument is as follows: a particular string may be tuned for producing a C note in the open condition. A pedal for raising the tone of that particular string may be attached whereby upon depression the tone will change to a D note. A second pedal or lever attached to the same string mechanism lowers the tone from that obtained in the open condition to a B note. Thereafter, when playing, if the musician wishes to raise the openly tuned C note string to the D note which is one full tone above the C note, he merely depresses the first pedal. However, with the first pedal depressed he is not able to produce a C sharp (C sharp being a half tone above the C), by depressing the second pedal, even though the second pedal is adjusted to lower the C note one half tone. With both pedals depressed the tone produced will be off key, somewhere between the C sharp and D tones and the C sharp sound cannot be achieved and another string must be utilized since split tuning heretofore was not possible. In other words, pedals which produce half tone or full tone pitch variations on conventional instruments strings from the open position will not maintain their full incremental tone variation when another pedal connected to the same string is depressed. Heretofore, simultaneous pedal utilization where both pedals controlled a single string produced tones from that string which were "off-key" or sharp and this problem has long been recognized in the industry. With this background in mind, the present invention was conceived in an effort to remedy the situation and produce tones "on-key" during simultaneous depression of two or more pedals controlling one string as the instrument is being played.

SUMMARY OF THE INVENTION AND DESCRIPTION OF THE DRAWINGS

This invention relates to an apparatus which allows a musical instrument such as a steel guitar to be split-tuned. Split-tuning consists of tuning the instrument so that when an openly tuned string is raised and lowered simultaneously a particular tonal increment, such as a whole or half tone, or multiples thereof, by depressing two foot or knee levers, the string's tone can be varied a full increment whether it be a half or full tone so the string remains "on-key" when two pedals relating to the particular string are pressed. In this way if a first pedal that is associated with a particular string for lowering the string's pitch, and a second pedal is associated with the same string for raising the string's pitch, then the tone produced when both pedals are simultaneously depressed is an intermediate tone or "split tuned" tone which is "on-key" and not "off" due to the sound being somewhere between two desirable scale notes.

For a more detailed description of the invention, referring to

FIG. 1, a typical steel guitar string is shown with various parts of the tone adjustment mechanism and pedal assembly displayed;

FIG. 2 is a close up view of the foot pedal cross-bar lever and the surrounding components;

FIG. 3 is an end view of FIG. 2;

FIG. 4 is a top view of the cross bar lever depicted in FIG. 2;

FIG. 5 is a side view of yet another tone changer lever;

FIG. 6 is an end view of FIG. 5;

FIG. 7 is yet another tone changer lever employing a tone adjusting means;

FIG. 8 is an end view of FIG. 7; and

Figure 1:
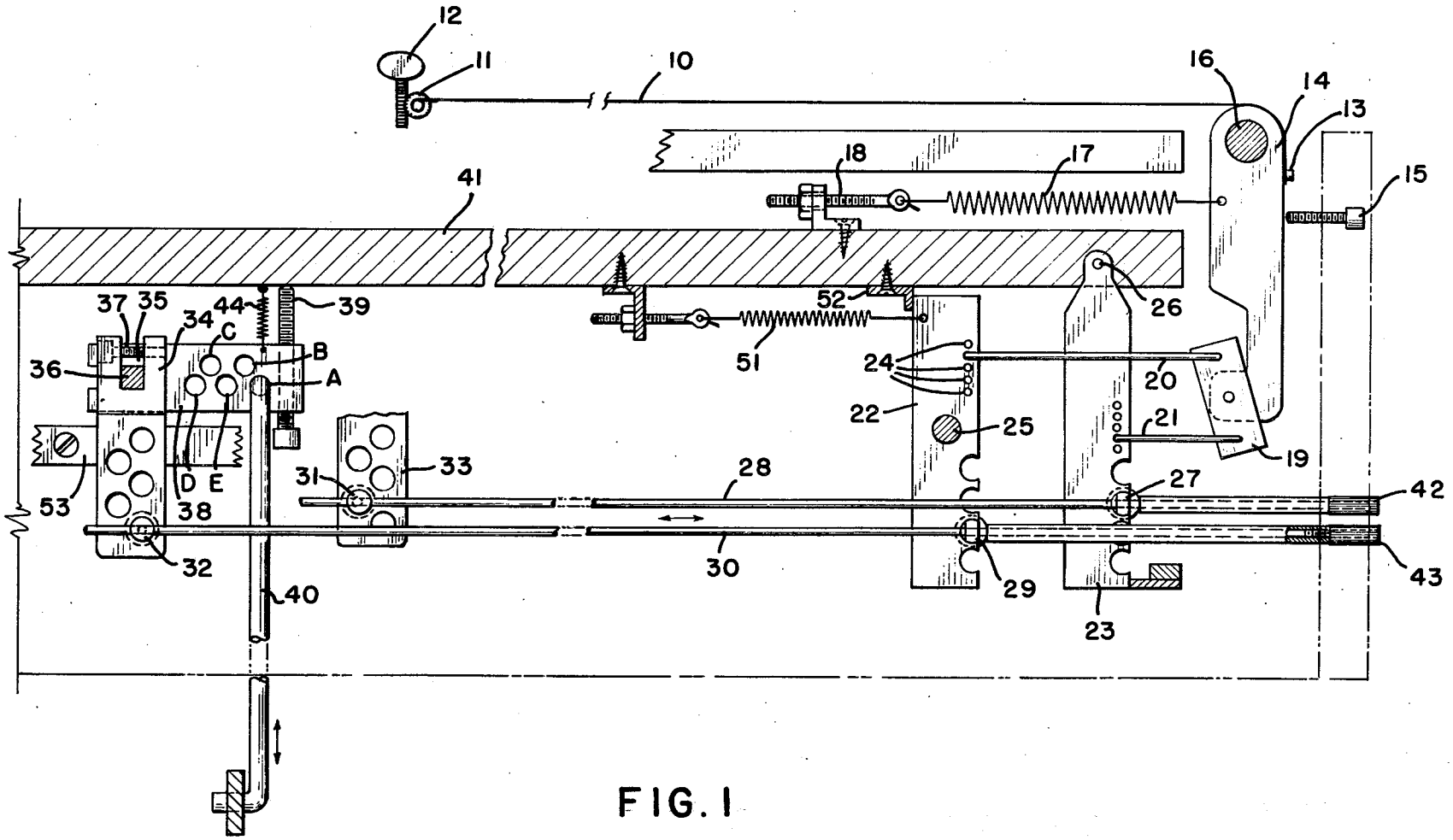

FIG. 9 demonstrates a schematic diagram of a typical tone changer lever.

For a more detailed description of the invention, referring to FIG. 1, the typical steel guitar string 10 is shown fragmented with one end attached to winding member 11 which rotates as tuning key 12 is turned.

It is conventional to tune string 10 in the open position, that is without any foot or knee pedals being engaged, by rotating the tuning key 12 until the desired tone is obtained as string 10 is plucked.

The opposite end of string 10, known as its "ball-end" 13 is affixed to a peg or a slot in tone changer lever 14. Tone adjusting means 15 is shown out of contact with tone changer lever 14 in FIG. 1. However, as tone changer lever 14 pivots around lever peg 16 in a counter clockwise direction towards tone adjusting means 15, contact will be made between lever 14 and adjusting means 15 and the tension on string 10 is lessened thereby producing lower tones as string 10 is plucked or played. Likewise, as lever 14 is rotated in a clockwise direction away from adjusting means 15, string 10 is tightened and produces tones of higher pitch. Spring 17 aids lever 14 by partially counteracting the tension imposed by string 10. Lever 14 is aided by spring 17 in its return to an "open" position from a "lowered" position as for example when lever 14 contacts tone adjusting means 15. Lever 14 is also aided as it moves from the "open" position to the "raised" position by the tension of spring 17 pulling lever 14 in a clockwise direction. Spring adjusting member 18 permits spring 17 to deliver the required tension to lever 14 and may be adjusted by turning it in or out.

Pivoting linkage member 19 is shown joined to the lower end of changer lever 14 and is connected to lowering linkage 20 and raising linkage 21. These linkages are connected to lowering lever 22 and raising lever 23 respectively. The connection between lowering linkage 20 and lowering lever 22 is adjustable and either a slot or a variety of positioning holes 24 may be provided. Lowering lever 22 pivots about lever axle 25 and raising lever 23 pivots around lever axle 26. Raising lever 23 is pivotably connected to swivel member 27 on raising rod 28 and lowering lever 22 is pivotably connected to swivel member 29 which is attached to lowering rod 30. Raising rod 28 and lowering rod 30 are joined by set screw swivels 31 and 32 respectively, each to self-aligning levers. Raising rod 28 is connected to self-aligning lever 33 and lowering rod 30 is connected to self-aligning lever 34. As shown, each self aligning lever has a variety of positioning holes for set screw swivels.

Both raising rod 28 and lowering rod 30 are connected to foot pedal assemblies though FIG. 1 only shows the mechanism which lowering rod 30 is connected for simplicity. It is understood that raising rod 28 has a similar mechanism through which it is also connected to a different foot pedal assembly from the foot pedal assembly which controls the movement of raising rod 30. Foot pedal assembly as used herein generally describes the foot pedals, the foot pedal rods, the self-aligning levers, cross bars and cross bar levers but does not include the raising or lowering rods.

As shown, self aligning lever 34 has a substantially rectangular slot 35 at its upper end into which cross bar 36 is seated. A self-aligning lever 34 is firmly affixed to cross bar 36 by securing means 37 which consists of a screw member. Cross bar lever 38 is also provided with a slotted end for rapid mounting and dismounting from cross bar 36 and is provided with stop means 39 which is adjustable. As shown in FIG. 1, cross bar lever 38 is joined to foot pedal rod 40 which is connected at its lower end to a conventional foot pedal (not shown).

As can be determined from the drawings, and particularly FIG. 1 as the first foot pedal (not shown) is depressed, rod 40 moves in a downward direction thus causing stop means 39 to move away from frame member 41 as cross bar lever 38 pivots in a clockwise direction with cross bar 36. Cross bar lever 38 in its fully depressed position contacts stop bar member 53 preventing further clockwise movement of cross bar lever 38. This rotation of cross bar 36 causes aligning lever 34 to rotate clockwise also and thereby urges lowering rod 30 to move outwardly, from right to left as shown in FIG. 1. The outward movement of lowering rod 30 pulls lowering lever 22, forcing it to rotate about its axis 25 and compels movement of lowering linkage 20 inwardly from left to right, thus creating a clockwise rotation of pivoting linkage member 19. This force exerted by lowering linkage 20 on linkage member 19 causes changer lever 14 to rotate counter clockwise towards tone adjusting means 15 thereby decreasing the tension on string 10 and providing a tone of lower pitch than would be provided in the open condition, prior to depression of the foot pedal as string 10 is played. When the first foot pedal (not shown) is released, the tension in spring 51 returns lowering lever 22 to its open position abutting lever stop member 52.

As the second foot pedal (not shown) which is associated with raising rod 28 is depressed, a similar action takes place as has just been described above with lowering rod 30. This is, raising rod 28 is caused to move in a right to left direction which influences raising lever 23 to move in a clockwise direction. The rotational movement of raising lever 23 causes raising linkage 21 to pull linkage member 19 in a clockwise direction thus causing changer lever 14 to pivot about lever peg 16 in clockwise rotation thereby tightening string 10 and providing a sound of high pitch.

As shown, raising rod 28 has an adjusting member 42 and lowering rod 30 has an adjusting member 43. For tuning purposes, the foot pedal associated with lowering rod 30 is depressed and rod adjusting means 43 can then be rotated to limit the movement of rod 30 and to obtain the desired pitch. Also, raising rod 28 can have its movement limited by the rotation of adjusting means 42 while the pedal associated with it (not shown) is depressed.

The preferred embodiment as shown in FIG. 1 utilizes foot pedals, though other pedals or levers could be substituted if desired.

FIG. 2 demonstrates pedal rod 40 positioned in opening B of cross bar lever 38. Other openings are shown in cross bar lever 38 for insertion of pedal rod 40 whereby the pedal leverage can be varied as desired. Resilient member 44 is shown in its relaxed position in FIG. 2 and this resilient or spring member will be expanded as rod 40 moves in its downward path. In its fully depressed position cross bar lever 38 contacts stop bar member 53 which prevents further clockwise movement of cross bar lever 38.

FIG. 3 illustrates foot pedal rod 40 in a downward or partially depressed condition with stop means 39 out of contact with frame member 41.

FIG. 4 shows a top view of cross bar lever 38 joined to cross bar 36. Cross bar mounting housing 45 is shown affixed to wall member 46 and provides cross bar 36 with proper seating to permit cross bar 36 to rotate freely when necessary.

FIG. 5 is another embodiment of a conventional tone changer lever 47 with a different design from that shown in the preferred embodiment which can also utilize a tone adjusting means in the form of adjustment screw 48 whereby the addition of adjustment screw 48 permits split-tuning.

FIG. 7 demonstrates yet another embodiment of a conventional tone changer lever and related components which can utilize a tone adjusting means 50 to allow split-tone tuning.

The mechanical elements relating to the split-tone tuner have been shown above and now a typical utilization of the invention will be described.

It is usual to tune a steel guitar initially in the open condition, as explained above by adjustment of the tuning keys. Thereafter, the strings are plucked with the foot pedals depressed for each particular string and adjustments are made to the pedal mechanism so that the proper tone will result with the pedals pressed. One or more pedals may be connected to any one string and after the string is tuned in the open condition, the first connected pedal is pressed and the particular string tuned. Next, the first pedal is released and the second pedal is pressed and the second pedal mechanism is adjusted for producing the desired tone. In this manner, a string with two pedal assemblies connected thereto may be capable of producing only three separate tones in conventional instruments. In a typical set-up the first pedal produces a tone when pressed of higher pitch than the "open condition" tone. With the first pedal released and the second pedal pressed, a tone of lower pitch is obtained than that string's "open condition" tone. If both pedals were pressed simultaneously, sounds emanating from the instrument would not have the proper tone quality and any listener could tell the sounds or notes were off-key or out of tune or sharp. However, the invention contained herein remedies this problem and allows the musician to play a particular string with both pedals pressed and producing notes of proper pitch.

Tuning of an instrument incorporating the invention contained herein i.e. as follows:

A typical string 10 as shown in FIG. 1 is adjusted by turning the tuning key 12 the proper amount whereby the string provides a tone of proper pitch in the open condition, for example, an E note. Next, a first foot pedal (not shown) as would be associated with raising rod 28 is fully depressed and the string is plucked and the pitch of the note is adjusted by turning rod adjusting means 42 until an F sharp note is achieved. Next, while holding the first foot pedal down a second foot pedal (not shown) which is connected to pedal rod 40 is fully depressed thereby urging lowering rod 30 outwardly from right to left as shown in FIG. 1 and the desired split pitched F note is obtained by turning rod adjusting means 43 as necessary. A lowered tone is next produced as only the second pedal is depressed during the playing of string 10. This is accomplished by depressing only the second pedal and rotating tone adjusting means 15 until an E flat tone is achieved.

At this point, the "open-condition" E note remains tuned as does the higher pitched F sharp note which results from only depressing the first foot pedal. Also the lower E flat tone remains in tune with the depression of only the second foot pedal and the split tone F is produceable with simultaneous depression of both pedals.

The instrument has now been totally tuned and the correct tones emanate in the open condition or with either or both pedals depressed.

The assembly shown in FIG. 1 limits the tone changer lever's 14 lowering movement however, other embodiments of the present invention could be manufactured which would limit lever 14's clockwise movement and this change or modification would also fall within the concept of the present invention.

In the example just explained, the pitch was raised one full tone by depressing the first pedal and was lowered a half tone by depressing the second pedal. However, any combination of raising and lowering incremental variations can be incorporated in the same manner.

As shown in FIG. 9, more rotation is required by lever 54 to increase in pitch a musical tone in string 55 as the string's tension increases due to the clockwise rotation of lever 54. Conversely, less rotation by lever 54 is required to lower in pitch the musical tone of string 55 as the string's tension decreases due to the counter clockwise rotation of lever 54. Graduation shown in FIG. 9 are musical tones.

Another important feature of the present invention is the "quick change" aspect of the aligning and cross bar levers. For example, the typical self-aligning lever 34 is shown in FIG. 1 having a rectangular slot 35 which allows self-aligning lever 34 to be quickly placed over cross bar 36 without disassembly of the cross bar or other components which are located nearby. Securing member 37 is then tightened into position whereby self-aligning lever 34 is locked onto cross bar 36, and is secured in position as long as it is deemed desirable. Later, if it is necessary to remove self-aligning lever 34, securing means 37 is removed and the self-aligning lever 34 is quickly removed from the cross bar 36.

The structures and mechanisms shown herein typify examples of the present invention and are not intended for purposes of limitation and variations hereof are contemplated which fall within the scope of the present invention.

I claim:

1. An apparatus for split-tuning a stringed musical instrument comprising: string means for producing an open condition tone, an open condition tone adjusting means, a first pedal means pivotally connected to said string means for varying the pitch of said string means producing a second tone, a second tone adjusting means, a second pedal means pivotally connected to said string means for varying the tonal pitch opposite to that imposed by said first pedal means and producing a third tone, a third tone adjusting means, and a fourth tone adjusting means for split-tuning said string means.

2. An apparatus for split-tuning a stringed musical instrument as claimed in claim 1, wherein said first pedal means is a pitch raising pedal means and said second pedal means is a pitch lowering pedal means whereby simultaneous pitch variation by said first and second pedal means produces a tone intermediate said second and third tones.

3. An apparatus for split-tuning a stringed musical instrument as claimed in claim 1, wherein said first pedal means is a pitch raising pedal means and said second pedal means is a pitch lowering pedal means whereby simultaneous pitch variation by said first and second pedal means produces a tone intermediate said first and second tones.

4. An apparatus for split-tuning a stringed musical instrument as claimed in claim 1, wherein said first pedal means is a pitch raising pedal means and said second pedal means is a pitch lowering pedal means whereby simultaneous pitch variation by said first and second pedal means produces a tone intermediate said first and third tones.

5. An apparatus for split-tuning a stringed musical instrument as claimed in claim 1, wherein said first pedal means is a pitch raising pedal means and said second pedal means is a pitch lowering pedal means whereby simultaneous pitch variation by said first and second pedal means produces a tone identical to said first tone.

6. An apparatus for split-tuning a stringed musical instrument as claimed in claim 1, wherein said string means includes a tone changer lever affixed to said string means, pivoting linkage means rotatably mounted on said tone changer lever, a first rod means joined to said pivoting linkage and to a first changer means, a second rod means joined to said pivoting linkage and to a second changer means, said first changer means being attached to a raising rod, said raising rod having a tone adjusting means at one end and being joined at its opposite end to a first aligning lever, said first aligning lever being connected to said first pedal assembly, said second changer means being attached to a lowering rod, said lowering rod having a tone adjusting means at one end and being joined at its opposite end to a second aligning lever, and wherein said second aligning lever is pivotably connected to a second pedal assembly.

7. An apparatus for split-tuning a stringed musical instrument as claimed in claim 6, wherein said first pedal assembly comprises a first pedal lever, said first pedal lever being pivotably joined to the upper end of a first pedal rod, and said first pedal rod is rotatably attached at its lower end to a first pedal.

8. An apparatus for split-tuning a musical instrument as claimed in claim 6, wherein said tone adjusting means limits the movement of said tone changer as said first pedal is depressed.

9. An apparatus for split-tuning a musical instrument as claimed in claim 6, wherein said tone adjusting means limits the movement of said tone changer as said second pedal is depressed.

10. An apparatus for split-tuning a musical instrument as claimed in claim 6, wherein said tone adjusting means limits the movement of said tone changer as both first and second pedals are depressed.

11. An apparatus for split-tuning a musical instrument as claimed in claim 6, wherein said tone adjusting means comprises a stop means.

12. An apparatus for split-tuning a musical instrument as claimed in claim 6, wherein said tone adjusting means comprises a stop-screw.

* * * * *